US006289998B1

(12) United States Patent
Krueger et al.

(10) Patent No.: US 6,289,998 B1
(45) Date of Patent: Sep. 18, 2001

(54) DOWNHOLE TOOL INCLUDING PRESSURE INTENSIFIER FOR DRILLING WELLBORES

(75) Inventors: Volker Krueger, Celle; Thomas Kruspe, Wienhausen, both of (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/226,885

(22) Filed: Jan. 7, 1999

Related U.S. Application Data

(60) Provisional application No. 60/070,753, filed on Jan. 8, 1998.

(51) Int. Cl.[7] ..... E21B 21/08
(52) U.S. Cl. ..... 175/25; 175/107
(58) Field of Search ..... 175/24, 25, 26, 175/93, 100, 107

(56) References Cited

U.S. PATENT DOCUMENTS

| | | | | |
|---|---|---|---|---|
| 3,112,800 | | 12/1963 | Bobo . | |
| 3,897,836 | | 8/1975 | Hall et al. | 175/93 |
| 3,927,723 | | 12/1975 | Hall et al. | 175/422 |
| 4,047,581 | | 9/1977 | Erickson . | |
| 4,462,469 | * | 7/1984 | Brown | 175/107 |
| 4,534,427 | | 8/1985 | Wang et al. . | |
| 4,729,675 | | 3/1988 | Trzeciak et al. | 384/613 |
| 4,819,745 | * | 4/1989 | Walter | 175/107 |
| 4,936,397 | * | 6/1990 | McDonald et al. | 175/107 |
| 4,982,801 | | 1/1991 | Zitka et al. | 173/163 |
| 5,073,877 | | 12/1991 | Jeter . | |
| 5,074,681 | | 12/1991 | Turner et al. | 384/613 |
| 5,079,750 | | 1/1992 | Scherbatskoy . | |
| 5,135,059 | | 8/1992 | Turner et al. | 175/101 |
| 5,246,080 | | 9/1993 | Horvei et al. | 175/93 |
| 5,361,857 | | 11/1994 | Horvei | 175/93 |
| 5,375,671 | | 12/1994 | Horvei | 175/93 |
| 5,455,804 | | 10/1995 | Holmes et al. . | |
| 5,632,604 | | 5/1997 | Poothodiyil . | |
| 5,817,937 | * | 10/1998 | Beshoory et al. | 73/152.46 |
| 5,890,547 | * | 4/1999 | Nilsen | 173/206 |
| 6,016,288 | * | 1/2000 | Frith | 367/85 |

FOREIGN PATENT DOCUMENTS

| | | |
|---|---|---|
| 0.661.459.A1 | 7/1995 | (EP) . |
| 2.281.424 | 3/1995 | (GB) . |
| WO 97/06336 | 8/1996 | (WO) . |
| WO 96/30618 | 10/1996 | (WO) . |
| WO 96/30619 | 10/1996 | (WO) . |

* cited by examiner

*Primary Examiner*—Thomas B. Will
*Assistant Examiner*—Meredith C Petravick
(74) *Attorney, Agent, or Firm*—Madan, Mossman & Sriram, P.C.

(57) ABSTRACT

A drilling system utilizing the drilling fluid in a borehole to drive an apparatus to generate a high-pressure jet of fluid to facilitate the drilling operation. A pressure intensifier disposed between a drilling motor and the drill bit generates high pressure fluid jet. The drilling motor rotates the pressure intensifier. Fluid enters a high pressure chamber in the pressure intensifier at selected location during each rotation. A piston in the pressure intensifier discharges the fluid from the high pressure chamber to the drill bit bottom at a high pressure. An electrically-operated pulse frequency control device generates fluid pulses of at least two frequencies, each such frequency defining a bit of a binary system.

30 Claims, 9 Drawing Sheets

DOWNHOLE TOOL INCLUDING PRESSURE INTENSIFIER FOR DRILLING WELLBORES

CROSS-REFERENCE TO RELATED APPLICATION

This application takes priority from U.S. patent application Ser. No. 60/070,753, filed Jan. 8, 1998, now abandoned.

BACKGROUND OF THE INVENTION

1. Field of the Invention

This invention relates generally to drilling wellbores and more particularly to a drilling system utilizing a downhole pressure intensifier for jet-assisted drilling.

2. Background of the Art

To obtain hydrocarbons such as oil and gas, boreholes are drilled by rotating a drill bit attached to a drill string. A large proportion of the current drilling activity involves directional drilling, i.e., drilling deviated and horizontal boreholes, to increase the hydrocarbon production and/or to withdraw additional hydrocarbons from the earth's formations.

Modern directional drilling systems generally employ a drill string having a drill bit at the bottom that is rotated by a drill motor (commonly referred to as the "mud motor"). A plurality of downhole devices are placed in close proximity to the drill bit to measure certain downhole operating parameters associated with the drill string and to navigate the drill bit along a desired drill path.

Positive displacement motors are commonly used as mud motors. U.S. Pat. No. 5,135,059, assigned to the assignee hereof and which is incorporated herein by reference, discloses a downhole drill motor that includes a power section having a housing, a stator having a helically-lobed inner elastomeric surface secured within the housing and a rotor having a helically-lobed exterior metallic surface disposed within the stator. Pressurized drilling fluid (commonly known as the "mud" or "drilling mud") is pumped into a progressive cavity formed between the rotor and stator. The force of the pressurized fluid pumped into the cavity causes the rotor to turn in a planetary-type motion. A suitable shaft connected to the rotor via a flexible coupling compensates for eccentric movement of the rotor. The shaft is coupled to a bearing assembly having a drive shaft (commonly referred as the "drive sub") which in turn rotates the drill bit attached thereto. Radial and axial bearings in the bearing assembly provide support to the radial and axial movements of the drill bit. For convenience, the power section and bearing assembly are collectively referred to herein as the "motor assembly." Other examples of the drill motors are disclosed in U.S. Pat. Nos. 4,729,675, 4,982,801 and 5,074,681, the disclosures of which are incorporated herein by reference.

For drilling in rock, the assistance of a jet of high pressure fluid facilitates the drilling operation. Some of the current operations supply the high pressure directly from the surface by either generating the high pressure for the entire fluid flow or operating a smaller amount of high pressure fluid via additional conduits inside the drill pipe. These prior art high pressure systems utilize high pressure pumps or pressure intensifiers at the surface. These systems are relatively expensive and unreliable and thus have not gained commercial acceptance.

The present invention addresses the above-described problems with the prior art methods for jet-assisted drilling and provides novel apparatus and methods for generating high pressure fluid flow downhole.

SUMMARY OF THE INVENTION

The present invention provides apparatus and methods for generating high pressure fluid jet downhole during drilling of the boreholes. The high pressure jet is discharged at the drill bit bottom to aid drilling of the boreholes. A preferred embodiment of the system includes a pressure intensifier disposed between a drilling motor and the drill bit. The drilling motor produces a rotary force as the drilling fluid passes through the drilling motor. The pressure intensifier includes a rotatable sleeve having at least one port for admitting drilling fluid. The rotary force of the drilling motor rotates the rotating sleeve causing the drilling fluid to enter a chamber. A reciprocating differential piston in the rotating sleeve discharges the fluid from the chamber at a high pressure to the drill bit bottom. The preferred embodiment utilizes a dual acting piston that reciprocates between two chambers. During each rotation of the rotating sleeve, the piston discharges at high pressure the fluid from each such chamber.

The pressure intensifier generates pulses of a defined frequency, which act as a carrier of signals and data transmitted uphole (to the surface). A pulse frequency control device or valve coupled to the drilling motor acts as the frequency modulator. A controller or processor in the downhole assembly operates the pulse control frequency device at at least two (at two or more) frequencies, each such frequency representing a binary bit of a digital signal.

Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, and wherein.

DETAILED DESCRIPTION OF PREFERRED EMBODIMENTS

Figure 1:
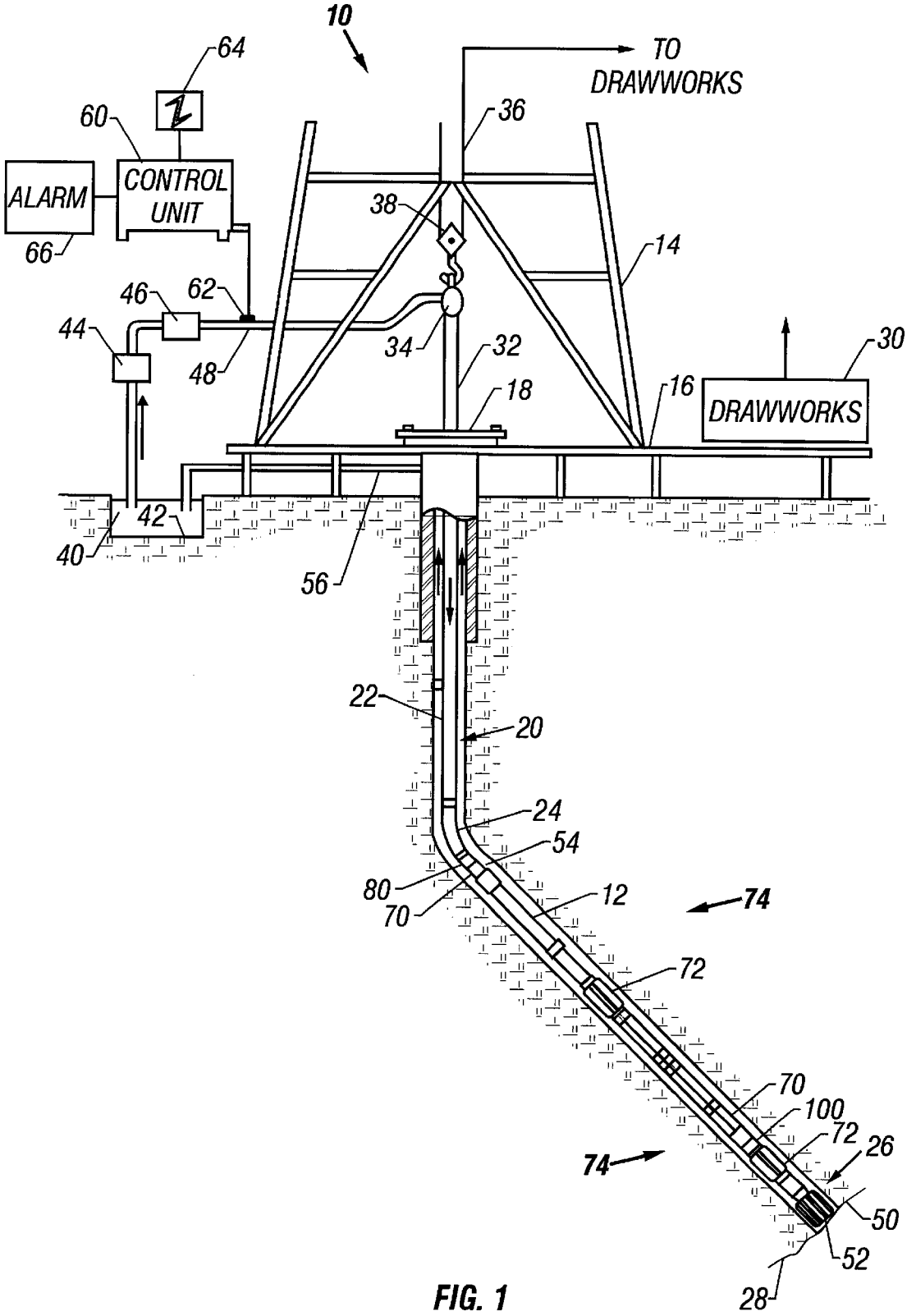
FIG. 1 shows a schematic diagram of a drilling system having a drill string containing a drill bit, mud motor and pressure intensifier according to a preferred embodiment of the present invention.
Figure 2A:
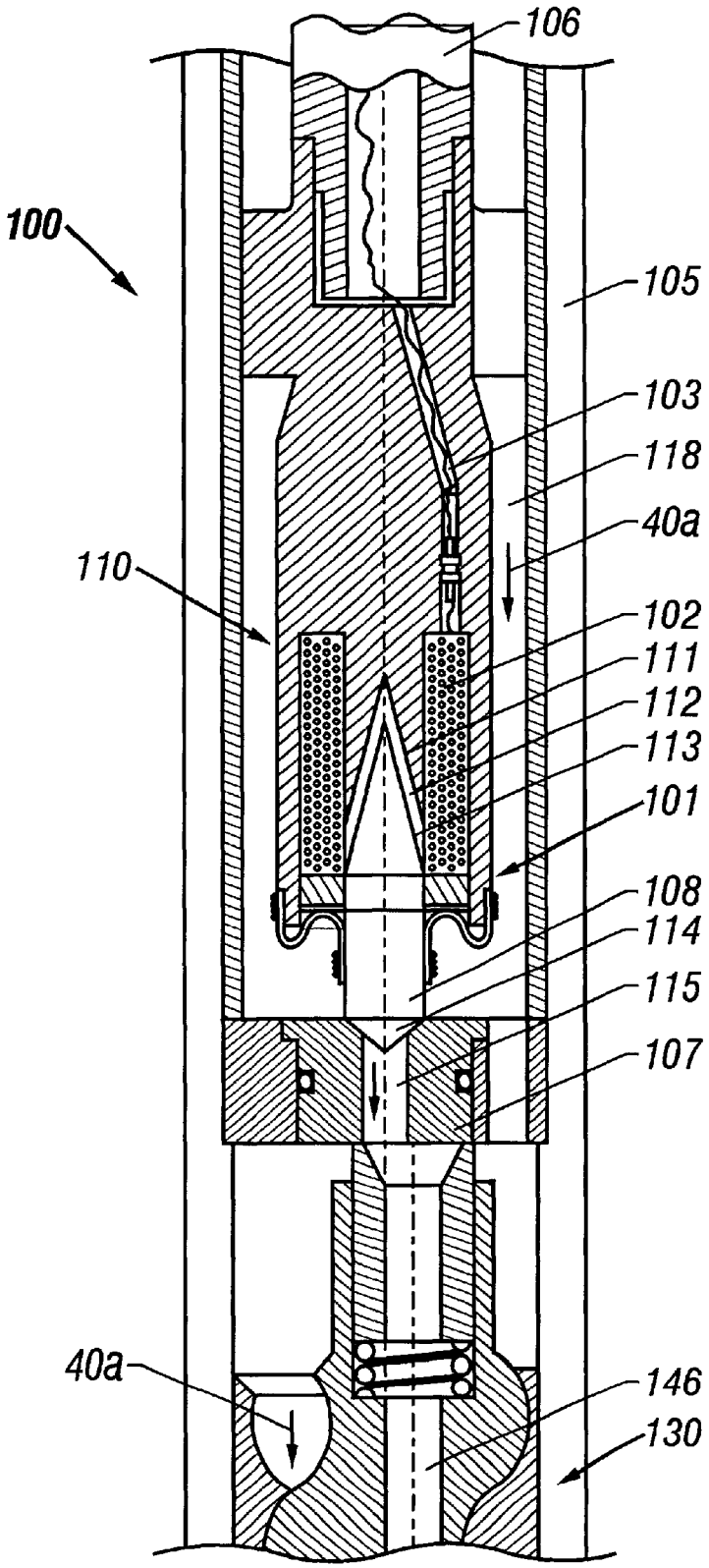
FIGS. 2A–2E show a cross-sectional view of a portion of a downhole assembly which includes a pressure intensifier that is driven or controlled by a mud motor and a data transmission apparatus that utilizes the pulses generated by the pressure intensifier to transmit data to the surface.
Figure 2B:
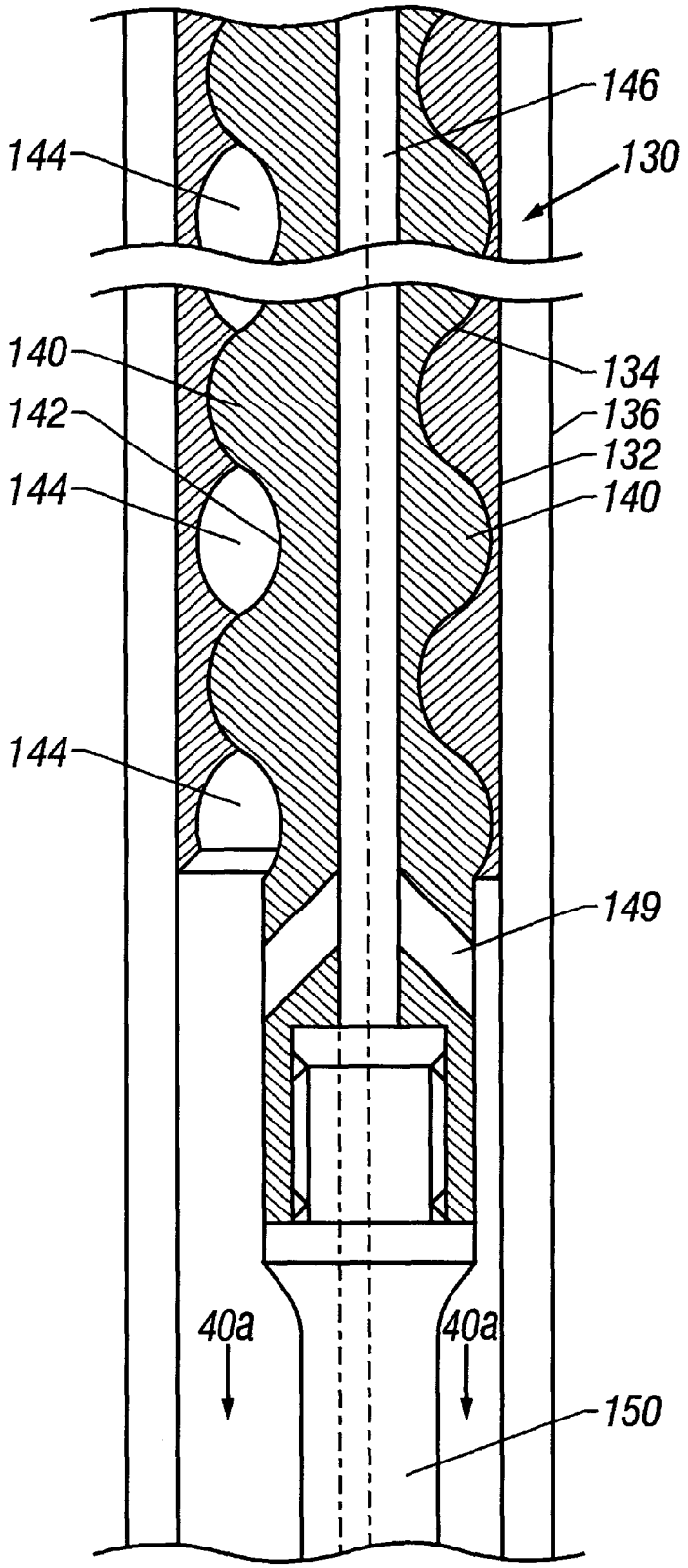
Figure 2C:
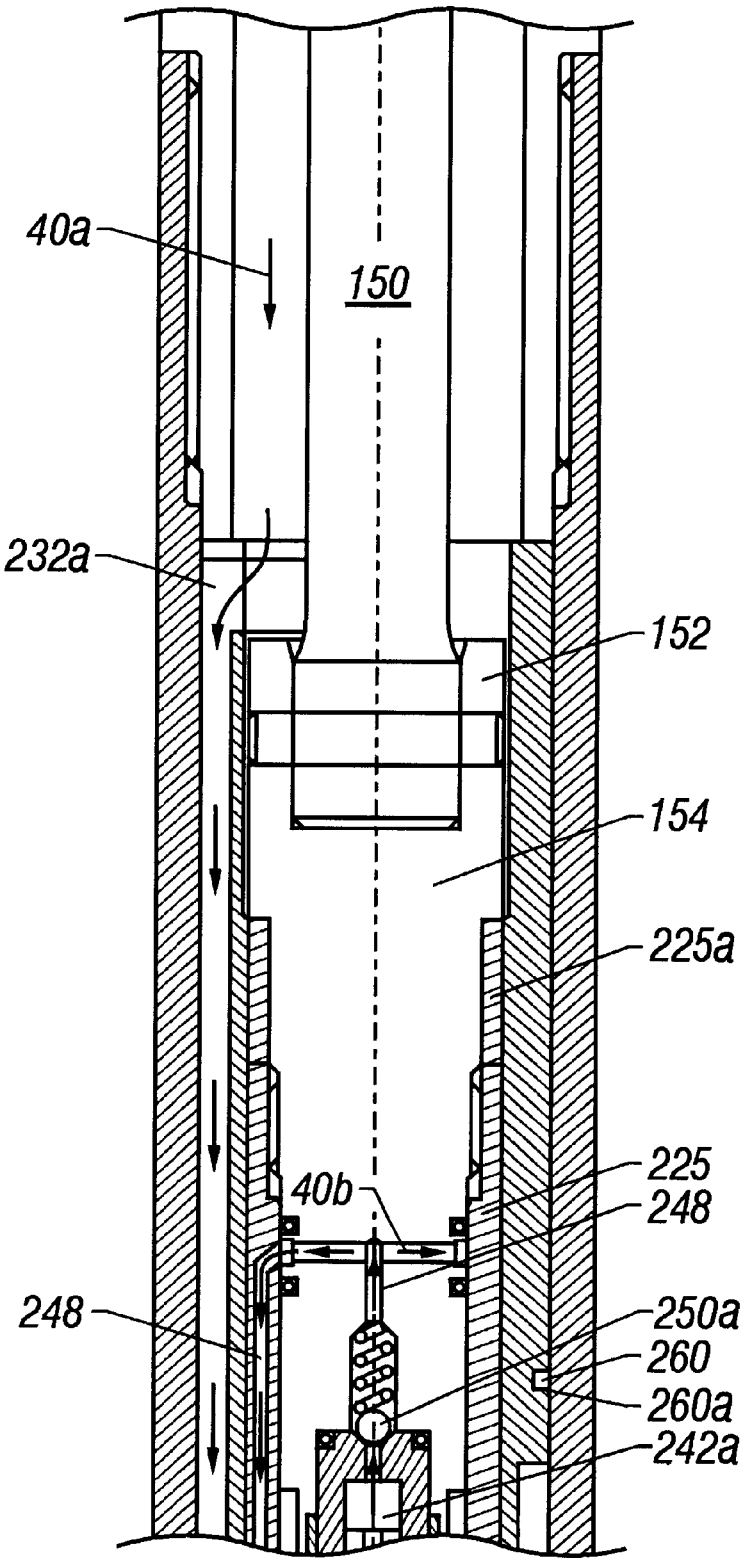
Figure 2D:
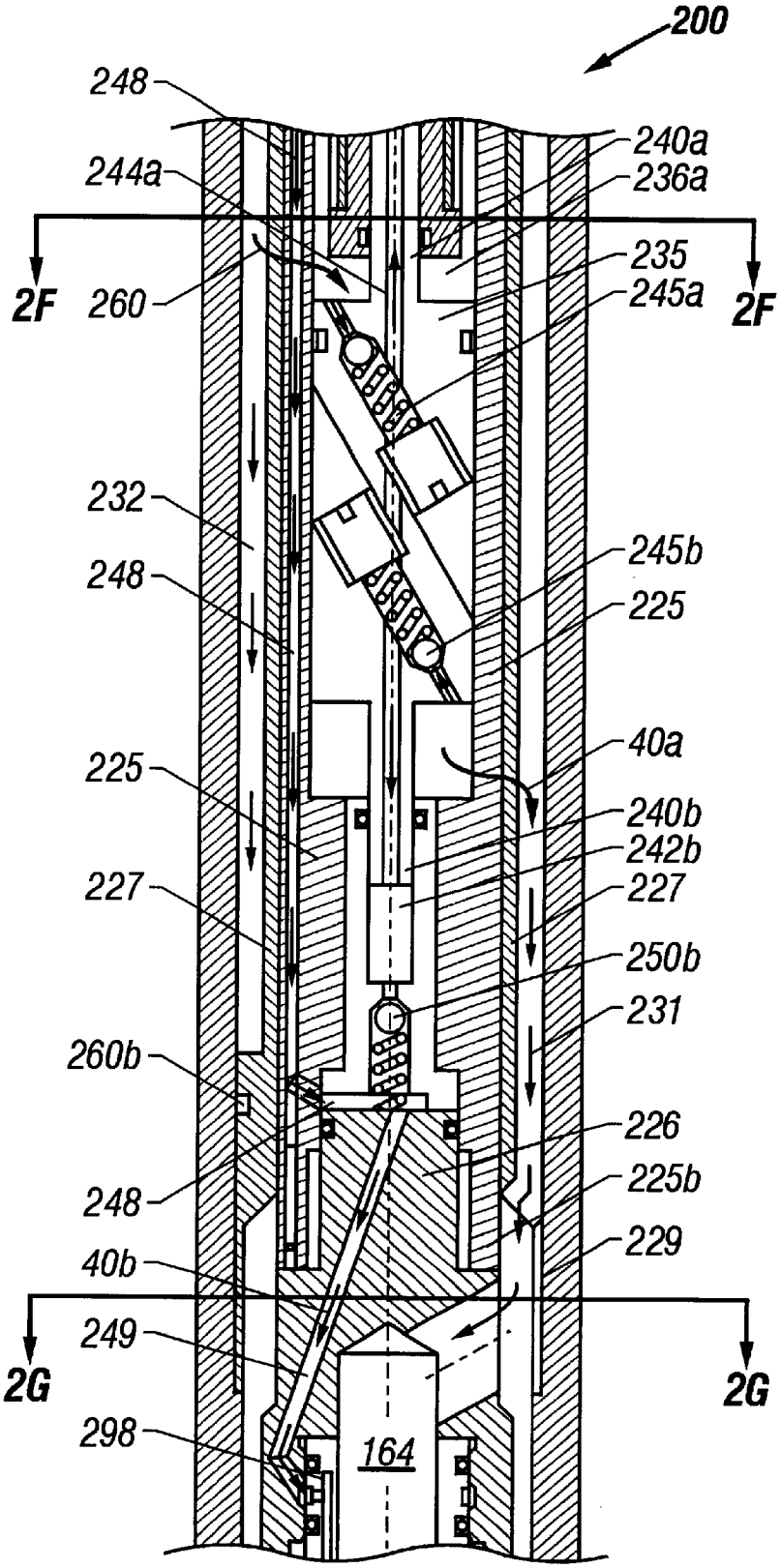
Figure 2E:
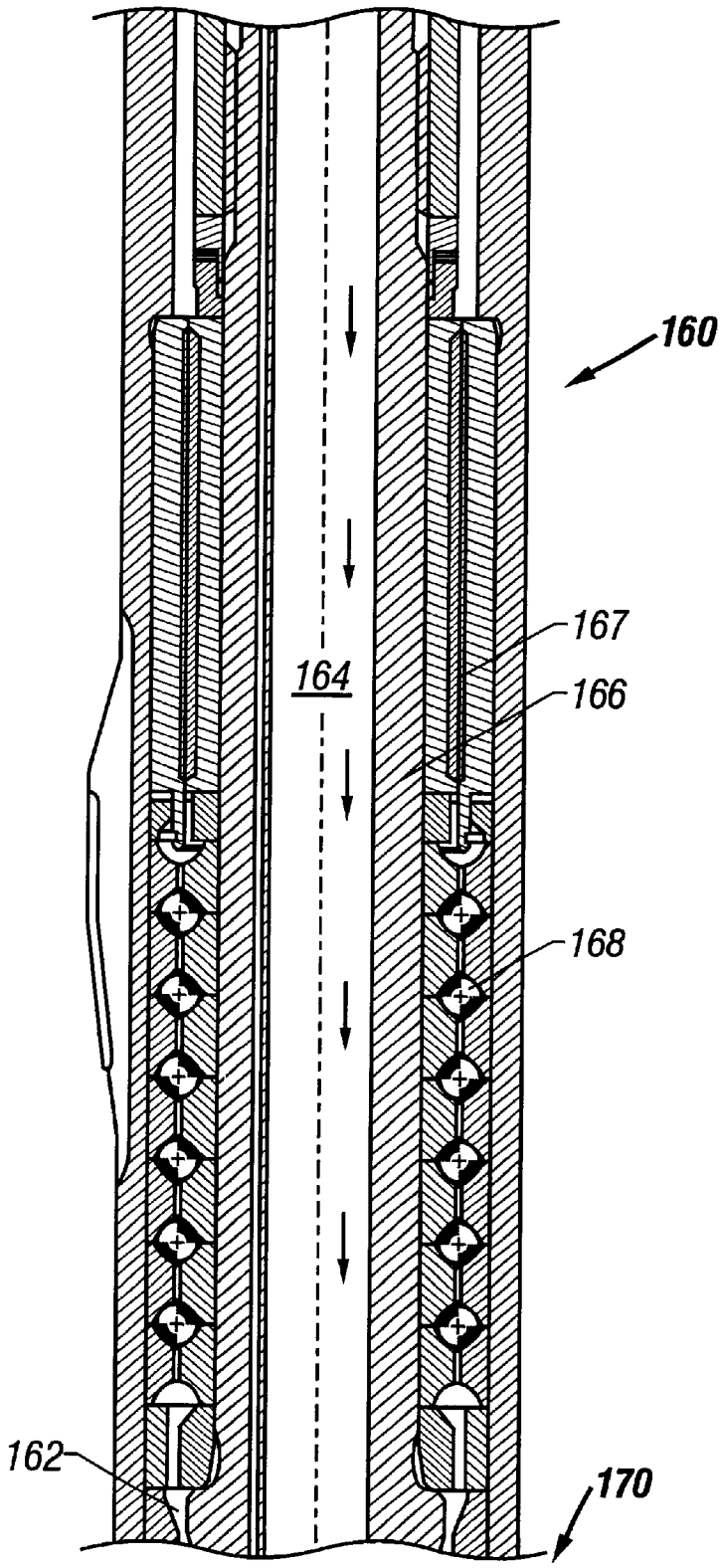
Figure 2F:
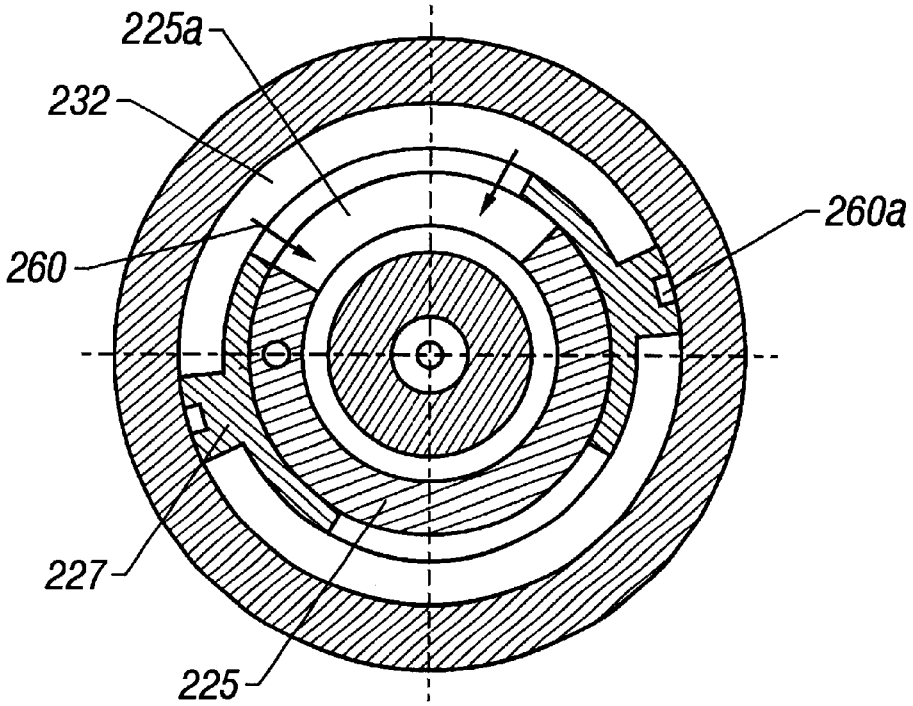
FIG. 2F is a section view taken from FIG. 2B along line 2F—2F showing the flow of low-pressure mud from the inlet channel to the pressure intensifier via the upper port of the pressure intensifier.
Figure 2G:
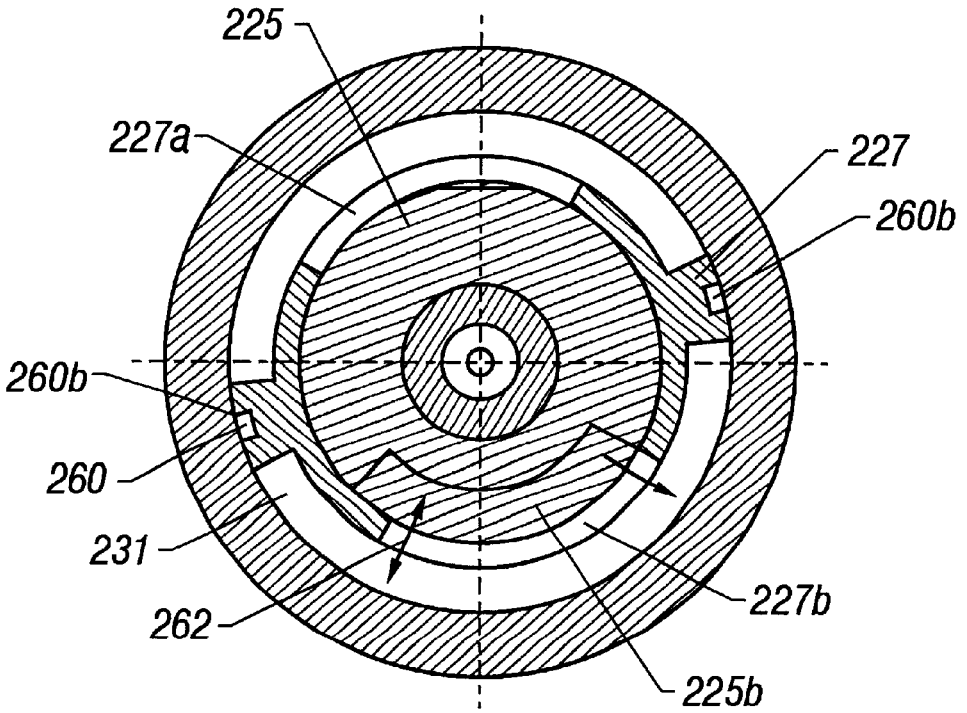
FIG. 2G is a section view taken from FIG. 2B along line 2G—2G showing the flow of low-pressure mud from the lower port to the outlet channel of the pressure intensifier.
Figure 3A:
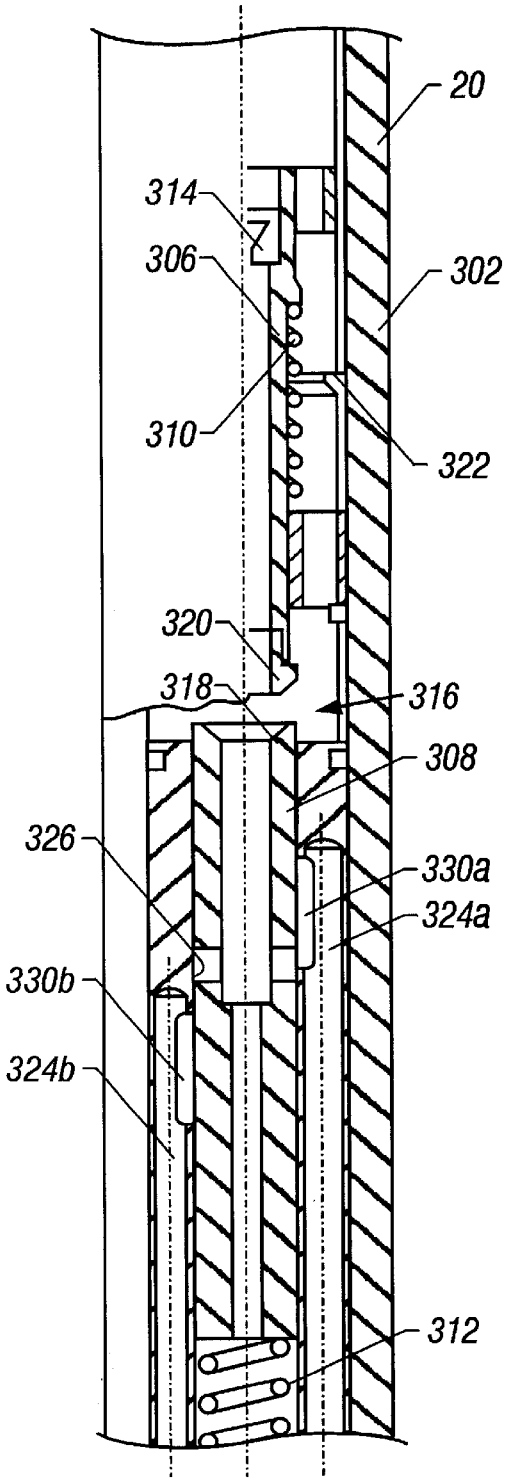
FIG. 3 (3A–3B) is a partial, cross-sectional view of a second preferred embodiment of a double-acting pressure intensifier with a control valve sub used as the driving mechanism for the pressure intensifier.
Figure 3B:
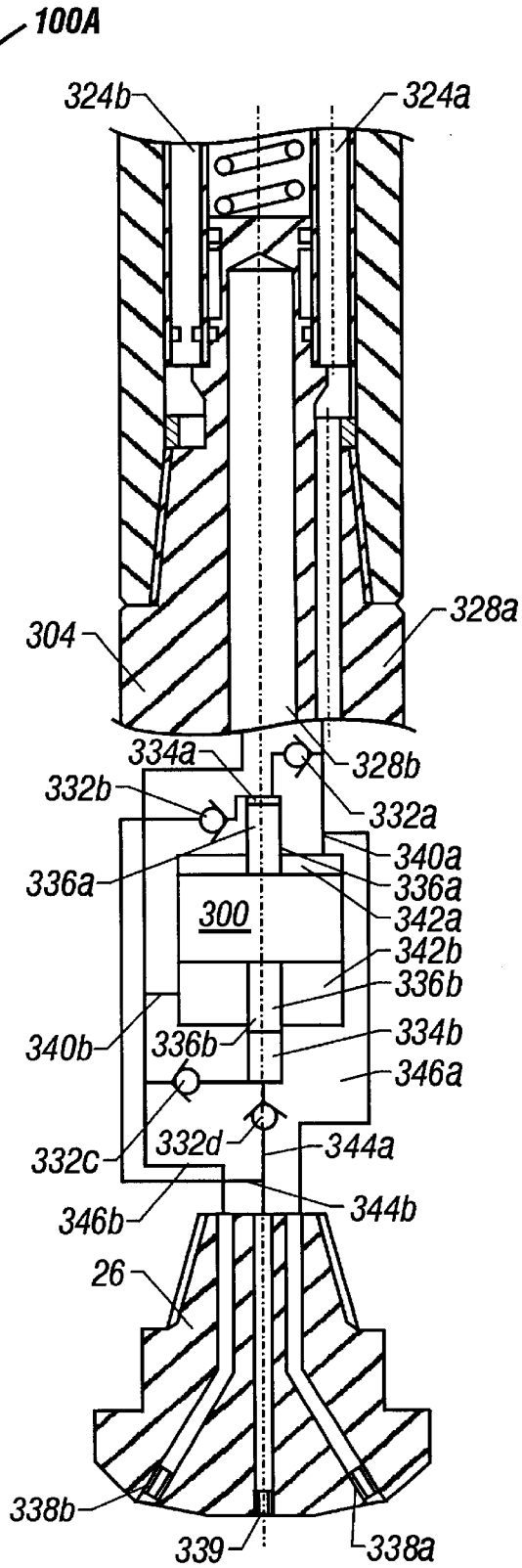
Figures 4, 4A, 4B:
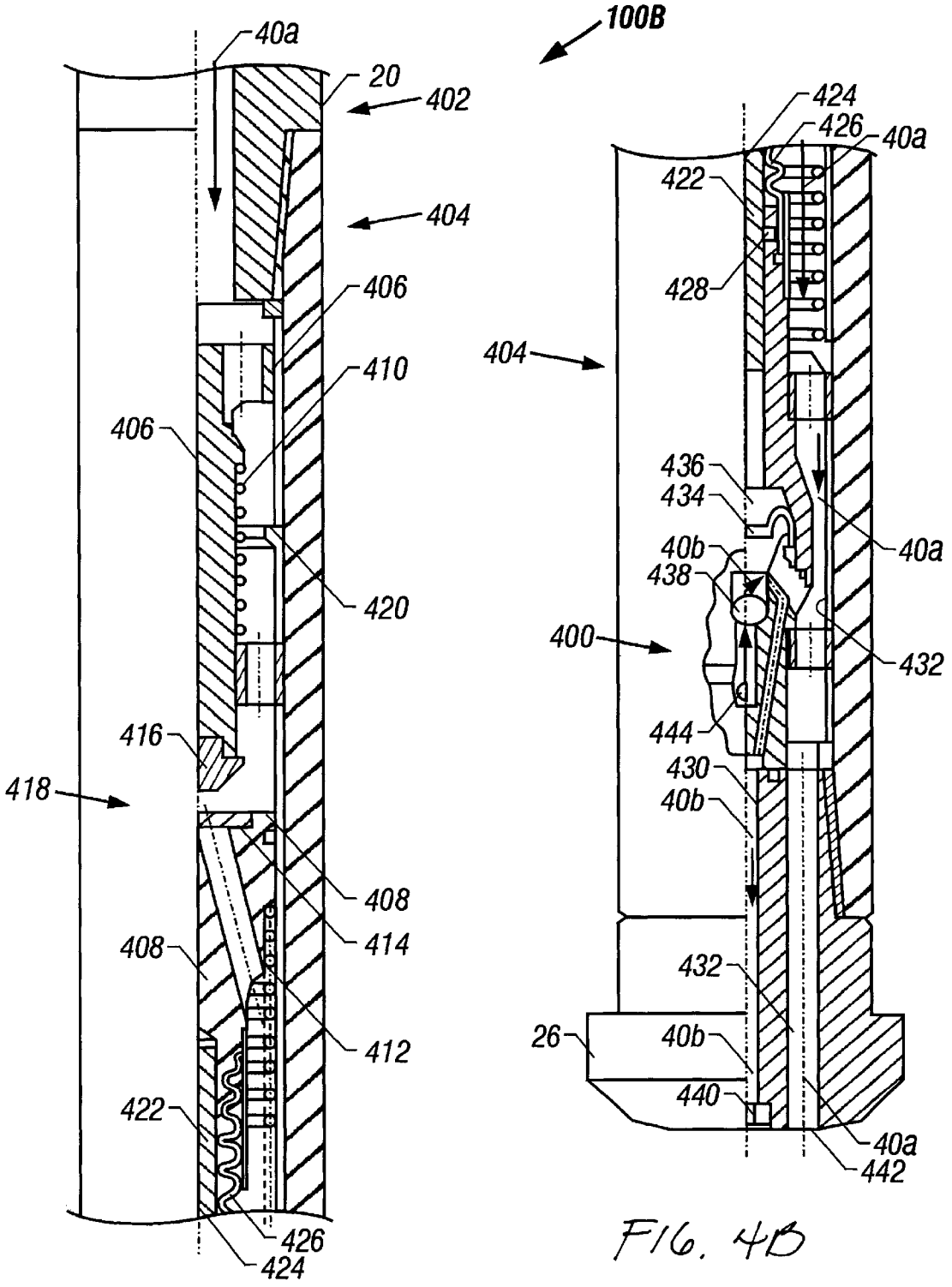
FIG. 4 (4A–4B) is a partial, cross-sectional view of a preferred embodiment of a driving mechanism operating with a single-acting pressure intensifier.

In general, the present invention provides a drilling system that utilizes a downhole pressure intensifier that provides high-pressure fluid jet or pulses which discharges at the telemetry to the drill bit bottom to more efficiently drill the boreholes. The drilling system further incorporates a system that utilizes the pressure pulses to transmit measurement-while-drilling ("MWD") signals and data uphole (to the surface). FIG. 1 is a schematic diagram showing a drilling system 10 which utilizes a drill string 20 for drilling a borehole 24. The drill string 20 includes a drill bit 26 at its bottom end carried by a bottom hole assembly or drilling assembly 74. FIGS. 2A–2G show an embodiment of a rotating pressure intensifier 100 for use in the drilling assembly 74 of the system 10. FIGS. 3–4 show alternative embodiments 100A–100B of the pressure intensifier 100 for use in a drill string 20.

The drilling system 10 of FIG. 1 is a schematic diagram of a typical drilling system 10 utilizing a mud motor 12 for driving the drill bit 26. The drilling system 10 includes a conventional derrick 14 erected on a platform 16 that supports a rotary table 18 that is rotated by a prime mover (not shown) such as a motor at a desired rotational speed. It is contemplated that the mud motor 12 of this invention may also be used with the so-called snubbing and coiled-tubing units (not shown).

A drill string 20, that includes a tubing 22, extends downward from the rotary table 18 into the borehole 24. The drill bit 26 disintegrates the earth formation 28 at the borehole bottom 50 when the drill bit 26 is rotated to drill the borehole 24. The drill string 20 is coupled to a drawworks 30 via a kelly joint 32, a swivel 34 and a line 36 through a pulley 38. During the drilling operation, the drawworks 30 is operated to control the weight-on-bit ("WOB") and the rate-of-penetration ("ROP") of the drill string 20 into the borehole 24. The operation of the drawworks 30 is well known in the art and is thus not described in detail herein.

During drilling operations a suitable drilling fluid (commonly referred to in the art as the "mud") 40 from a mud pit 42 is circulated under pressure through the drill string 20 by a mud pump 44. The mud 40 passes from the mud pit 42 into the drill string 20 via a desurger 46, a fluid line 48 and the kelly joint 32. The mud 40 flows downward through the tubing 22 and then the bottom hole assembly 74 and is discharged at the bottom of the borehole 24 through one or more openings 52 in the drill bit 26, such as passages 338*a*–338*b* and 339 shown in FIG. 3B. The drilling mud 40 carrying the cuttings circulates uphole through the annular 54 between the drill string 20 and the borehole 24 and is discharged into the mud pit 42 via a return line 56.

A surface control unit 60 coupled to a sensor 62 placed in the fluid line 48 is used to control the drilling operation and to display desired drilling parameters and other information on a display/monitor 64. The surface control unit 60 preferably contains a computer, memory for storing data, recorder for recording data and other peripherals (not shown). The control unit 60 processes data with a central processing unit (not shown) and executes program instructions and responds to user commands entered through a suitable means, such as a keyboard, a graphical pointing device or any other suitable device (not shown). The surface control unit 60 preferably activates alarms 66 when certain unsafe or undesirable operating conditions occur. The surface control unit 60 also operates as the receiver for the mud pulse data transmission.

The drilling motor or mud motor 12, coupled to the drill bit 26 via the drive shaft (not shown) disposed in the bearing assembly 70, rotates the drill bit 26 when the drilling mud 40 is passed through the mud motor 12 under pressure. The bearing assembly 70 supports the radial and axial forces of the drill bit 26, the downthrust of the drill motor 12 and the reactive upward loading from the applied weight-on-bit. A stabilizer 72 coupled to the bearing assembly 70 acts as a centralizer for the lowermost portion of the mud motor assembly 74.

The first preferred embodiment of the pressure intensifier system 100 is illustrated in FIGS. 2A–2G. This embodiment also includes a data transmission apparatus or device 110 for transmitting data pulses to the surface in the form of modulated pressure pulses generated by the pressure intensifier.

The various devices of the pressure intensifier system 100 are disposed in an outer housing 105 which connects at its upper end to a tubing (not shown). Various electronic circuits and components relating to the system 100 are preferably disposed in a pressure tight housing 106 disposed uphole of the data transmission apparatus 110. The operation of the mud motor 130 and the pressure intensifier 200 will be described before describing the operation of the data transmission apparatus 110.

The mud motor 130 includes a power section that contains an elastomeric stator 132 having an inner lobed surface 134. The stator 132 is securely affixed in an outer housing 136. A rotor 140 having an outer lobed surface 142 is rotatably disposed in the stator 130. The lobes of the stator 130 and the rotor 140 are such that they create a series of cavities 144 between the rotor and stator lobed surfaces. The rotor 140 has a passage 146 which can be utilized to bypass a certain amount of the drilling fluid to alter the mud motor 130 rotational speed. As the mud 40*a* flows from the pulse frequency controller 110 to the mud motor 130, it passes through the cavities 144, thereby turning (rotating) the rotor 140. The mud 40*a* leaves the mud motor 130 at the lower end of the power section of the drilling motor and enters the pressure intensifier 200 at ports 232*a*. The bypass fluid leaves the rotor at ports 149. The rotor 130 rotates a flexible shaft 150, which is coupled to the pressure intensifier 200 via a coupling 152.

The pressure intensifier 100 is preferably integrated into the mud motor assembly which is usually composed of the mud motor 130, flexible shaft 150 and the bearing assembly 160. The pressure intensifier 100 is shown disposed between the flexible shaft 150 and the bearing assembly 160 in the configuration of FIGS. 2A–2G. The pressure intensifier 200 includes a rotatable housing 225, which is coupled at its upper end 225*a* to the flexible shaft 150 at the coupling 154. The lower end 225*b* of the housing 225 is coupled to the drive shaft 162 in the bearing assembly 160 via a coupling 226. As the rotor 140 rotates, it rotates the flexible shaft 150, which rotates the coupling 154 and thus the pressure intensifier housing 225. The housing 225 in turn rotates the coupling 226, which rotates the drive shaft 162 and thus the drill bit 170. In the system 100, the mud motor 130 drives the pressure intensifier 100 rather than a separate driving mechanism, such as shown in FIGS. 3–4.

The rotating housing 225 is disposed in a non-rotating valve sleeve 227, which is fixed within the outer housing 105. The non-rotating sleeve 227 creates two channels: an inlet fluid channel 232 (FIG. 2F) between the outer housing 105 and the non-rotating sleeve 227 that receives the low pressure drilling fluid 40*a* from the motor 130 and an outlet channel 231 for discharging the low pressure fluid 40*a* to the bearing assembly 160. An upper seal 260*a* and a lower seal 260*b* provide seals between the non-rotating sleeve 227 and the outer housing 105. The non-rotating sleeve 227 has openings 227*a* and 227*b*, which allow fluid 40*a* to flow from the channel 232 to the rotating sleeve 225. The rotating sleeve 225 has an upper port 225*a* and a lower port 225*b*, each of which comes in fluid communication with fluid 40*a* via the openings 227*a* and 227*b* during each rotation of the rotating sleeve 225.

A double acting piston 235 reciprocates between an upper chamber 236*a* and a lower chamber 236*b* which are formed by the piston and the rotating sleeve 225. The upper end of the piston 235 has an upper pressure plunger 240*a* that reciprocates in an upper plunger chamber 242*a*. The lower end of the piston 235 has a lower pressure plunger 240*b* that reciprocates in a lower plunger chamber 242*b*. An upper suction check valve 245*a* is disposed in a hydraulic line 244*a* connecting the upper chamber 236*a* and the upper plunger chamber 242*a* to allow the fluid 40*a* to flow from the upper chamber 236*a* to the upper plunger chamber 242*a*. Similarly, a lower suction check valve 245*b* is disposed in a hydraulic line 244*b* that connects the lower chamber 236*b* and the lower plunger chamber 242*b* to allow the fluid 40*a* to flow from the lower chamber 236*b* to the lower plunger chamber 242*b*. An upper outlet check valve 250*a* allows the high pressure fluid 40*b* to discharge from the upper plunger chamber 242*a* into a high pressure channel 248. Similarly, a lower outlet check valve 250*b* allows the high pressure fluid 406 to discharge from the lower plunger chamber 242*b* into the high pressure channel 249.

The operation of the pressure intensifier 100 will now be described while referring to FIGS. 2A–2G. The low pressure drilling fluid 40*a* causes the mud motor 130 to rotate, which rotates the rotating sleeve 225 causing the upper port 225*a* and the lower port 225*b* to come in fluid communication with the inlet channel 232 depending on the rotational position of the rotating sleeve 225 relative to the non-rotating sleeve 227. FIG. 2F is the cross-section of the pressure intensifier 200 taken along 2F—2F. It shows the upper port 225*a* in fluid communication with the inlet channel 232. FIG. 2G is the cross-section of the pressure intensifier taken at 2G—2G when the rotating sleeve is in the same position as shown in FIG. 2F. It shows the lower port 225*b* in fluid communication with the outlet channel 231 after a rotation of ninety degrees (90°). Here the rotating sleeve 225 is in transition phase i.e., from connecting the upper port 225*a* with the inlet channel 232 and the lower port 235*b* with the outlet channel 231 to connecting the upper port 225*a* with the outlet channel 231 and the lower port 235*b* with the inlet channel 232. For a certain amount of time during this transition phase, each of the ports 235*a* and 235*b* connects to both the inlet channel 232 and the outlet channel 231. During this time, the fluid 40*a* bypasses the pressure intensifier 200, which ensures continuous supply of the fluid 40*a* to the drill bit 170 and a constant rotation of the mud motor 130. During each revolution of the rotating sleeve 225, (i) the upper port 225*a* comes in fluid communication with the outer channel 231 for a portion of the rotation, (ii) the lower port with the inlet channel 232 for a portion of the rotation, and (iii) for a portion of the rotation such fluid communications occur simultaneously. This is accomplished by configuring the radial dimensions of the inlet channel 232, outlet channel 231, and the upper and lower ports 225*a*–225*b* such that there always is a certain amount of low pressure fluid 40*a* flowing from the inlet channel 232 to the outlet channel 231, which ensures continuous rotation of the mud motor 130.

When the upper port 225*a* is in fluid communication with the inlet channel 232, the low pressure fluid 40*a* enters the upper chamber 236*a* as shown by arrow 260 pushing the piston 235 and the lower plunger 240*b* downward. The downward movement of the piston 235 (a) discharges the low pressure fluid 40*a* from the lower chamber 236*b* into the outlet channel 231 and (b) causes the lower plunger 240*b* to discharge the fluid from the lower plunger chamber 242*b* into the high pressure channel 248 via check valve 250*b*. The high pressure fluid 40*b* from the line 248 passes to the drill bit 270 via a connecting high pressure line 249. Simultaneous with the discharge of the fluid from the lower chamber 236*b*, the low pressure fluid 40*a* enters into the upper chamber 236*a* and into the upper plunger chamber 242*a* via suction check valve 245*a* and line 244*a*. It should be noted that the inlet channel 232, the outlet channel 231 and the upper and lower ports 225*a*–225*b* are configured such that there always is a certain amount of the low pressure fluid 40*a* flowing from the inlet channel 232 to the outlet channel 231 to ensure continuous rotation of the mud motor 130.

When the lower port 225*b* comes in fluid communication with the inlet channel 232, the low pressure fluid 40*a* enters the lower chamber 236*b*, filling the lower chamber 236*b* and the lower plunger chamber 242*b*. The piston 235 moves upward, causing the upper plunger 240*a* to discharge the fluid from the upper plunger chamber 242*a* into the high pressure channel 248 at the high pressure. Thus, each rotation of the rotating sleeve 225 causes the piston 235 to stroke once upward and once downward, thereby supplying two pulses of the high pressure fluid 41*a* to the drill bit 170. The low pressure fluid 40*a* is supplied continuously to the drill bit.

The high pressure line 249 supplies the high pressure fluid to the drill bit 170 via a suitable channel 162. The low pressure fluid 40*a* from the outlet channel 231 discharges into the passage 164 in the drive shaft 166, which rotates the drill bit 170. The bearing assembly 160 includes radial bearings 168 and axial bearings 167, which respectively provide radial and axial support to the drive shaft 166. The high pressure fluid 40*b* is discharged at the drill bit bottom via a passage 162 while the low pressure fluid 40*a* is discharged via multiple passages 164.

The pressure intensifier 100 described above and shown in FIGS. 2A–2G produces pressure pulses during each rotation of the housing 225 (FIG. 2D). These pressure pulses normally interfere with mud pulse telemetry signals commonly utilized for transmitting data and signals from the downhole assembly 100 to the surface. This invention provides a novel method for transmitting signals uphole that are unaffected by the pressure pulses generated by the pressure intensifier 100. In the preferred mode, this is accomplished by utilizing a pulse frequency control device or valve 110 to transmit signals from the downhole assembly 74 to the surface. The preferred pulse frequency control valve 110 includes a solenoid valve 101, which contains a solenoid coil 102 with a conical end 111. The solenoid coil is energized according to programmed instructions from a control circuit (not shown) in the downhole assembly 74 via conductors 103. A valve poppet 108 having a compliant conical side 113 is disposed in the conical end 111. The other end 114 of the valve poppet 108 seals an opening 115 in a seat 107. The valve poppet seals the opening in the normal closed position, as shown in FIG. 2A. When the solenoid coil 102 is energized, the valve poppet moves uphole, which unseats the valve poppet 108 from the valve seat 107 thereby allowing the low pressure drilling fluid 40*a* to pass from the passage 118 to the mud motor via the passage 115.

As described above with reference to FIG. 1, data from the measurement-while-drilling devices and other sensors carried by the downhole assembly is transmitted to the surface. In the present invention, the signals are transmitted as pulse-modulated signals produced by the pulse frequency control valve 110 utilizing the pressure pulses produced by the pressure intensifier 100 as a carrier. To transmit a signal, for example a series of ones and zeroes, the solenoid is selectively activated and deactivated to increase or reduce the frequency to produce the required signal. For example a "one" may be defined as a first operating frequency of the pulse frequency control valve 110 and a zero as a second operating frequency. Thus, the signals are transmitted as a series of pulses. More than two frequencies may be utilized for special signals, such as the beginning and/or end of a signal series or for other special purposes. The above method provides for frequency modulated signals. Amplitude modulated pulses and other types of pulses may also be utilized to transmit signals. A processor or controller, preferably in the electronic section 106 (FIG. 2A), controls the operation of the pulse frequency control valve 110. This processor includes a microprocessor, memory and other related circuitry. One or more programs are stored in the memory downhole, which provide instructions to the microprocessor respecting the control of the valve 110. The process also may include circuitry to receive command signals from the surface control unit 60 (FIG. 1), which may be programmed to send command signals to the downhole processor. The downhole processor controls the operation of the valve 110 according to the programmed instructions stored downhole and/or commands received from the surface control unit 60.

The second preferred embodiment of the pressure intensifier 100A that uses an alternative double-acting pressure intensifier/piston 300 is shown in FIG. 3. This pressure intensifier 100A includes a control valve sleeve 302 and a pressure intensifier sub 304. The control valve sleeve 302 is the driving mechanism for the double-acting pressure intensifier/piston 300 and includes a valve piston 306 and an oscillating piston 308. The valve piston 306 is slidably mounted in the control valve sleeve 302. A valve spring 310 urges the valve piston 306 upwards into its open, biased position. The oscillating piston 308 also is slidably mounted within the control valve sleeve 302. A main spring 312 urges the oscillating piston 308 upwards into its open, biased position.

An optional bypass nozzle 314 is used in the preferred embodiment to optimize the action of the drilling system 10. The operation of the bypass nozzle 314 is well known in the industry and, therefore, is not discussed in detail. For ease of understanding, the following description assumes that the bypass nozzle 314 is in the closed position.

One cycle of the double-acting pressure intensifier/piston 300 includes four phases. In the first phase, the oscillating piston 308 is forced upward by the biasing action of the main spring 312. At the end of Phase 1, a valve 316 is closed when a valve seat 318 contacts a valve body 320 of the valve piston 306 and the oscillating piston 308 comes to rest against the valve piston 306.

In Phase 2, the valve 316 is closed and the drilling mud 40 cannot flow between the valve seat 318 and the valve body 320. This creates flow pressure against both the valve piston 306 and the oscillating piston 308, forcing the valve spring 310 and the main spring 312 to compress. This compression allows the valve piston 306 and the oscillating piston 308 to move downwards at the same rate, thus keeping the valve 316 in the closed position. When the valve piston 306 reaches the stop shoulder 322, Phase 2 ends.

In Phase 3, the valve piston 306 stops its downward motion when the valve piston 306 reaches the stop shoulder 322 and the valve spring 310 forces the valve piston 306 to oscillate back upwards, pulling the valve body 320 away from the valve seat 318. At the same time, due to high inertia, the oscillating piston 308 maintains its downward direction of movement, further widening the gap between the valve body 320 and the valve seat 318, thereby opening the valve 316 which allows the mud 40 to flow downhole. This ends Phase 3.

The fourth and final phase starts (a few tenths of a second after the valve piston 306 reverses its direction) when the oscillating piston 308 stops due to the full compression of the main spring 312. Because the mud 40 is flowing through the open valve 316 relieving the fluid pressure on the top of the oscillating piston 308, the main spring 312 decompresses thereby forcing the oscillating piston 308 upward. The upward movement of the oscillating piston 308 is the beginning of Phase 1 and the cycle starts again.

The oscillating piston 308 of the preferred embodiment is designed as a sliding valve which connects the flow of drilling mud 40 to either a first actuator channel 324*a* or a second actuator channel 324*b*. The connection is made between the mud 40 and the first actuator channel 324*a* when the oscillating piston 308 is located towards the top of its upward path such that an aperture 326 in the oscillating piston 308 is adjacent a first inlet chamber 330*a* which is in fluid communication with the first actuator channel 324*a*. Similarly, when the oscillating piston 308 is towards the bottom of its downward path, the aperture 326 is adjacent to a second flow chamber 330*b* which is in fluid communication with the second actuator channel 324*b* thereby allowing the mud 40 to flow into the second actuator channel 324*b*.

Pressure is created by the delta in the flow rate across the low-pressure nozzles 338*a–b*. If fluid is pumped into one of the low-pressure actuator channels 324*a*, then that flow rate is removed from the other low-pressure actuator channel 324*b* and a pressure differential is created. The double-acting piston 300 is driven by whichever channel (the first or second actuator channel 324*a–b*) is connected to the flow path of the drilling mud 40*a*. Driving pressure is established by the difference (drop) in pressure across the low-pressure nozzles 338*a–b*.

An upper plunger 336*a* and a lower plunger 336*b* act as pumps in conjunction with four check valves 332*a–d* (two per plunger). The high pressure is created across the high-pressure nozzle 339 inside the drill bit 26. The high-pressure fluid jet (not shown) is directed at the bottom of the wellbore 24 to support the drilling process.

Both low-pressure actuator channels 324*a–b* are connected to the double-acting pressure intensifier 300 and to the outlets (low-pressure nozzles) 338*a–b*, respectively. Part of the flow of low-pressure mud 40*a* from the first actuator channel 324*a* goes through a first low-pressure line 346*a* and exits the drill string 20 through the first low-pressure nozzle 338*a*. Due to high pressure forming in the double-acting pressure intensifier 300 by the action of high-pressure plungers 336*a–b*, another part of the low-pressure mud 40*a* flows into an upper chamber 342*a* of the double-acting pressure intensifier 300 through a first chamber line 340*a*.

The final part of the low-pressure mud 40*a* flows into a first low-pressure inlet 328*a* in the pressure intensifier 304. The first check valve 332*a* opens when the double-acting pressure intensifier/piston 300 is traveling downwards creating lower pressure in an upper plunger cavity 334*a*. This causes the upper plunger cavity 334*a* to equalize the pressure by sucking the low-pressure mud 40*a* from the first low-pressure inlet channel 328*a* through the first check valve 332*a* into the upper plunger cavity 334*a*. Continuing downward, the double-acting piston 300 forces the mud 40 in a lower plunger cavity 334*b* through a fourth check valve 332*d* at a higher pressure into a first high-pressure nozzle line 344*a*.

As the double-acting piston 300 reaches its bottom stroke, it reverses direction whereby the mud 40 from the second low-pressure input channel 328*b* is sucked from a second low-pressure nozzle line 346*b* through a third check valve 332*c* into a lower chamber 342*b* in the pressure intensifier 300. As the upper plunger 336*a* moves upwards, the pressure on the mud 40 in the upper plunger cavity 334*a* increases and keeps a second check valve 332*b* closed.

The low-pressure mud 40*a* that flows through the second actuator channel 324*b* passes through an aperture 326 into a second inlet chamber 330*b* and through a second low-pressure line 346*b* and exits the drill bit 26 through a second low-pressure nozzle 338*b*.

A third preferred embodiment 100B is illustrated in FIG. 4. This embodiment uses a single-acting pressure intensifier 400. A lower end 402 of the drill string 20 is connected to a pressure intensifier 404. A valve piston 406 and a pressure intensifier piston 408 are slidably mounted inside the pressure intensifier sub 404. The valve piston 406 and the pressure intensifier piston 408 are pushed back into their normal biased positions (up) by a valve spring 410 and a main spring 412, respectively.

As in the double acting pressure intensifier 300 (as shown in FIG. 3), one cycle of the single acting pressure intensifier 400 includes four phases. In Phase 1, the pressure intensifier piston 408 is driven upward by the biasing action of the main spring 412. When a valve seat 414 reaches a valve body 416 of the valve piston 406, a valve 418 closes and Phase 1 ends.

At the start of Phase 2, the valve 418 is closed and the drilling mud 40*a* cannot flow between the valve seat 414 and the valve body 416. This creates flow pressure against both springs (the valve spring 410 and the main spring 412) forcing them downward which allows the valve piston 406 and the pressure intensifier piston 408 to move downward until the valve piston 406 reaches a stop shoulder 420. This is the end of Phase 2.

In Phase 3, the valve piston 406 stops its downward motion when the valve piston 406 reaches the stop shoulder 422 and the valve spring 410 forces the valve piston 406 to oscillate back upwards pulling the valve body 416 away from the valve seat 414. At the same time, due to high inertia, the pressure intensifier piston 408 maintains its downward direction of movement, further widening the gap between the valve body 416 and the valve seat 414 thereby opening the valve 418 which allows the mud 40 to flow through. This ends Phase 2.

The fourth and final phase starts (a few tenth of a second after the valve piston 406 reverses its direction) when the pressure intensifier piston 408 stops due to the full compression of the main spring 412. Because the mud 40 is flowing through the open valve 418 relieving the fluid pressure on the top of the pressure intensifier piston 408, the main spring 412 decompresses thereby forcing the pressure intensifier piston 408 upwards. This upward movement of the pressure intensifier piston 408 is the beginning of Phase 1 and the cycle starts again.

The pressure intensifier piston 408 includes a plunger 422 which is guided inside a cylindrically-shaped passageway 424 and is protected by a bellows 426 which also acts as a means for pressure compensation. A high-pressure seal 428 separates a high-pressure channel 430 from a low-pressure channel 432 of the plunger 422. To have clean drilling mud 40 in both channels (the high pressure channel 430 and the low-pressure channel 432), a high-pressure membrane 434 is positioned to separate the high-pressure drilling mud 40*b* from a pressure-transmitting fluid 436. A ball-check valve 438 serves as a suction valve for the plunger 422.

The up and down action of the plunger 422 in the passageway 424, creates a pressure differential and low-pressure mud 40*a* in the low-pressure channel 432 is sucked through an inlet 444 into the ball-check valve 438. The high-pressure mud 40*b* discharging through the ball-check valve 438 flows through the high-pressure channel 432 and exits the drill bit 26 as a high-pressure jet through the high-pressure nozzle 440 which is located inside the drill bit 26 and directed downwards towards the bottom of the wellbore 24.

The remainder of the low-pressure mud 40*a* (that is not diverted through the inlet port 444 to the ball-check valve 438) continues flowing through the low-pressure channel 432 and exits the drill string 20 through a low-pressure nozzle 442 in the drill bit 26 where it circulates uphole through the annular space 54 (see FIG. 1) between the drill string 20 and the borehole 24 for discharge back into the mud pit 42 to complete the cycle.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A downhole assembly for use in drilling of a wellbore, said downhole assembly including a drill bit at an end thereof and adapted to receive drilling fluid from a source thereof during drilling of the wellbore, said drilling assembly comprising:

(a) a drilling motor generating rotary force upon application of the drilling fluid thereto, said drilling motor adapted to rotate the drill bit to drill the wellbore; and (b) a pressure intensifier operated by the rotary force generated by the drilling motor, said pressure intensifier when operating receiving the drilling fluid at a first low pressure and discharging the received drilling fluid at a second high pressure.

2. The downhole assembly according to claim 1, wherein the pressure intensifier discharges the drilling fluid as fluid pulses at the second high pressure.

3. The downhole assembly according to claim 1, wherein the pressure intensifier comprises:

(i) a rotatable sleeve that is rotated by the rotary force of the drilling motor;

(ii) at least one chamber receiving the drilling fluid at the first low pressure during rotation of the rotatable sleeve; and (iii) a piston discharging the drilling fluid from the at least one chamber at the second high pressure.

4. The downhole assembly according to claim 3, wherein the piston is a dual acting piston that acts on two spaced apart chambers during rotation of the rotatable sleeve to discharge fluid from each said chamber in the form of fluid pulses at the second high pressure.

5. The downhole assembly according to claim 1, wherein the pressure intensifier comprises:

(i) a rotating sleeve that is rotated by the rotary force of the drilling motor;

(ii) an inlet channel adjacent to the rotating sleeve receiving the drilling at the first low pressure;

(iii) two chambers, each such chamber receiving the drilling fluid from the inlet channel during rotation of the rotating sleeve; and (iv) a piston reciprocating between the two chambers, said piston alternately discharging the drilling fluid from the two chambers at the second high pressure.

6. The downhole assembly according to claim 1, wherein the pressure intensifier is disposed between the drill bit and a power section of the drilling motor.

7. The downhole assembly according to claim 1 further comprising a passage for discharging the drilling fluid at the second high pressure from the pressure intensifier to bottom of the drill bit.

8. A downhole assembly for drilling a wellbore, said drilling assembly adapted to carry a drill bit at an end thereof and to receive drilling fluid from a source thereof, comprising:

(a) a pressure intensifier to generate high pressure drilling fluid pulses; and (b) a pulse frequency control device to generate fluid pulses at at least two frequencies, each said frequency representing a binary bit of a digital signal.

9. The downhole assembly according to claim 8 further comprising a drilling motor for generating a rotary force that operates the pressure intensifier to generate the high pressure drilling fluid pulses.

10. The downhole assembly according to claim 9, wherein the at least two frequencies are different from frequency of the high pressure fluid pulses generated by the pressure intensifier.

11. The downhole assembly according to claim 8, wherein the pulse frequency control device is a solenoid valve.

12. The downhole assembly according to claim 9 further comprising a processor that selectively activates and deactivates the pulse frequency control device to generate the pulses at the at least two frequencies.

13. The downhole assembly according to claim 12, wherein the processor includes a microprocessor, and wherein the processor controls the pulse frequency control device according to instructions provided thereto.

14. The downhole assembly according to claim 13, wherein the instructions are stored in a memory downhole or provided from a remote location.

15. An apparatus utilizing fluid supplied to a wellbore for transmitting data, comprising:

(a) a pressure intensifier supplying high pressure pulses of a drilling fluid to a drill bit for drilling of the wellbore; and (b) a pulse frequency control device generating fluid pulses at at least two frequencies, each frequency representing a binary bit, said pulses at the at least two frequencies utilizing the pulses generated by the pressure intensifier as a carrier for transmitting said binary bits to through the wellbore.

16. The apparatus according to claim 15 further comprising a processor operatively coupled to the pulse frequency control device to generate a series of pulses at said at least two selected frequencies representing data.

17. The apparatus according to claim 15, wherein the pulse frequency control device is a solenoid valve disposed in a fluid passage in said apparatus.

18. A method of drilling a wellbore with a drilling assembly adapted to carry a drill bit at end thereof, said method comprising:

(a) generating rotary force by a drilling motor in the wellbore by supplying a drilling fluid at a first low pressure to the drilling motor from a drilling fluid source;

(b) providing a pressure intensifier in the wellbore and operating the pressure intensifier by the rotary force generated by the drilling motor to produce fluid pressure pulses at a second high pressure; and (c) supplying said fluid pressure pulses at the second high pressure to the drill bit to aid the drill bit in the drilling of the wellbore.

19. The method according claim 18, wherein the pressure intensifier includes a rotatable sleeve and operating the pressure intensifier comprises rotating the rotatable sleeve by the rotary force generated by the drilling motor.

20. The method according to claim 19, wherein the pressure intensifier further includes (i) at least one chamber and (ii) a piston and the step to produce fluid pressure pulses at a second high pressure comprises receiving the drilling fluid in the at least one chamber at the first low pressure during rotation of the rotatable sleeve and discharging the received drilling fluid from the chamber by the piston at the second high pressure.

21. The method according to claim 20, wherein the at least one chamber comprises two spaced apart chambers and the piston is a dual acting piston that acts on the two spaced apart chambers during rotation of the rotatable sleeve to discharge fluid from each said chamber in the form of fluid pulses at the second high pressure.

22. The method according to claim 18 wherein providing the pressure intensifier comprises disposing the pressure intensifier between the drill bit and a power section of the drilling motor.

23. The method according to claim 18 further comprising generating fluid pulses at at least two frequencies, each said frequency representing a binary bit of a digital signal.

24. The method according to claim 23 wherein the frequencies of the fluid pulses at different from frequency of the high pressure fluid pulses generated by the pressure intensifier.

25. The method according to claim 23 further comprising transmitting the digital signals using frequency of the high pressure fluid pulses as a carrier wave.

26. The method according to claim 23 further comprising controlling the frequencies of the pressure pulses according to programmed instructions.

27. A method of drilling a wellbore by downhole assembly that includes a pressure intensifier that supplies high pressure fluid pulses to a drill bit at an end of the downhole assembly, said method comprising:

(a) generating high pressure fluid pulses by the pressure intensifier;

(b) supplying the high pressure fluid pulses generated by the pressure intensifier to the drill bit to aid in the drilling of the wellbore;

(c) generating fluid pressure pulses at at least two selected frequencies, each such frequency representing a binary bit of a digital signal; and (d) transmitting the binary bits utilizing frequency of the high pressure pulses as a carrier signal.

28. The method according to claim 27, wherein generating fluid pressure pulses at the at least two selected frequencies comprises generating said pulses at frequencies which are different from frequency of the high pressure pulses generated by the pressure intensifier.

29. The method according to claim 27 wherein generating the fluid pressure pulses at the at least two frequencies comprises generating such pulses by a solenoid valve and drilling fluid supplied from a surface location to the downhole assembly.

30. The method according to claim 29 further comprising controlling the at least two selected frequencies according to programmed instructions provided to the downhole assembly.

* * * * *